US005515541A

United States Patent [19]

Sacks et al.

[11] Patent Number: 5,515,541

[45] Date of Patent: May 14, 1996

[54] FLEXIBLE ARMOR

[75] Inventors: Michael Sacks, P.O. Box 456, Manchester M60 2LL, United Kingdom; Glynn Jones, Manchester, United Kingdom

[73] Assignee: Michael Sacks, Manchester, United Kingdom

[21] Appl. No.: 244,231

[22] PCT Filed: Nov. 20, 1992

[86] PCT No.: PCT/GB92/02154

§ 371 Date: Sep. 23, 1994

§ 102(e) Date: Sep. 23, 1994

[87] PCT Pub. No.: WO93/10419

PCT Pub. Date: May 27, 1993

[30] Foreign Application Priority Data

Nov. 23, 1991 [GB] United Kingdom ..... 9124918
Aug. 3, 1992 [GB] United Kingdom ..... 9216474

[51] Int. Cl.[6] ..... F41H 1/02

[52] U.S. Cl. ..... 2/2.5

[58] Field of Search ..... 89/36.01, 36.02, 89/36.05; 428/911; 2/2.5

[56] References Cited

U.S. PATENT DOCUMENTS

| | | | |
|---|---|---|---|
| 2,819,759 | 1/1958 | Goodloe | 2/2.5 X |
| 3,813,281 | 5/1974 | Burgess et al. | 2/2.5 X |
| 3,867,239 | 2/1975 | Alesi et al. | 2/2.5 X |
| 4,287,607 | 9/1981 | Leach | 2/2.5 |
| 4,951,689 | 8/1990 | Jones | 2/2.5 X |

FOREIGN PATENT DOCUMENTS

| | | | |
|---|---|---|---|
| 226265 | 6/1987 | European Pat. Off. | 2/2.5 |
| 9208604 | 5/1992 | European Pat. Off. . | |
| 21282 | of 1905 | United Kingdom | 2/2.5 |
| 425066 | 3/1935 | United Kingdom . | |
| 915345 | 1/1963 | United Kingdom | 2/2.5 |
| WO91/06821 | 5/1991 | WIPO . | |

*Primary Examiner*—C. D. Crowder
*Assistant Examiner*—Paul C. Lewis
*Attorney, Agent, or Firm*—Banner & Allegretti

[57] ABSTRACT

Armor resistant to knife attack comprises a flexible sheet having a threat side facing a direction of threat and a protected side adjacent, in use, an area to be protected, and a plurality of armor plates attached to the sides of the sheet, the plates being grouped such that a first group attached to the protected side is in overlapping registration with a second group attached to the threat side, the registration being such that exposed regions of sheet on the threat side register with the first group of plates so preventing penetration of the armor through the exposed regions. By placing the overlapping groups on separate sides of the sheet, the armor is made more flexible than arrangements where the plates are mounted on the same side and are in engagement.

24 Claims, 5 Drawing Sheets

FLEXIBLE ARMOR

TECHNICAL FIELD

This invention relates to armor for providing protection against projectiles or knife attack. In particular, it relates to body armor for protecting, at least part, of a wearer's body.

It is known to produce garments including plates of bullet-resistant and/or knife-resistant material to protect a wearer.

U.S. Pat. No. 4,951,689 discloses a surgeon's glove comprising a flexible sheet material to which are attached on one side thereof disc-like plates. The plates are attached at a central point to a projection of the sheet material and are arranged to overlap. This arrangement is designed to counter the accidental thrust of a needle or scalpel, but if a similar arrangement were used to counter a knife or bullet thrust, it would be inflexible due to frictional forces generated by overlapping contacting regions of the discs.

Whilst it is possible to produce armor which successfully resists knife attack, it is another matter to produce armor which is flexible enough to be worn for long periods without discomfort and to allow a wide range of movement. It is an object of the invention to provide such body armor.

DISCLOSURE OF THE INVENTION

Accordingly, the invention provides armor comprising a flexible sheet having a threat side facing a direction of threat and a protected side adjacent an area to be protected in use, and a plurality of armor plates attached to the sides of the sheet and grouped such that the plates of a first group attached to the protected side are in overlapping registration with the plates of a second group attached to the threat side, the registration being such that exposed regions of sheet on the threat side register with plates of the first group so preventing penetration of the armor through the exposed region; characterised in that the armor plates comprise discs.

By arranging the plates in this manner, the plates of the first group and second group overlap but do not make contact reducing the frictional forces generated by flexing. Further, the plates do not prevent the edges of the other plates moving out of the plane of the sheet. The flexibility of the armor is thus greatly increased. For greatest flexibility, the plates are attached at a substantially central region of the plate.

By threat side it is meant, the side onto which a projectile or knife or other hazardous object may impinge. The protected side is the side which is adjacent the body of the wearer of the armor or adjacent an area or object to be protected.

An example of an object to be protected, is a vehicle which may itself be an armored or a so called 'soft' non-armored vehicle. An area to be protected could be a medical or other personnel occupied area. The flexibility of armor according to the invention is particularly advantageous in such applications since it permits compact storage, and easy deployment and storage by rolling the armour.

It is envisaged that the armor could be draped over an object because of its flexibility or erected in the manner of a tent or awning. The well known canvas or other flexible material tops provided for weather protection of personnel or materiel carried in the rear of lorries or similar vehicles could be replaced or augmented by armor in accordance with the invention.

Such an arrangement would confer conveniently deployable protection against shrapnel and anti-personnel weaponry such as bombs including flechettes. Flechettes are short arrows or darts designed primarily for inflicting injury on personnel.

By virtue of the armor's lightness and flexibility it may be worn by personnel in the ordinary course of their duties not just when an attack is anticipated. Thus the armor may be worn by policemen or police-women during their normal duties. The armor may also be used to protect the horses of mounted police.

The flexible sheet may be formed of a single material, woven or non-woven, or formed from a composite material. In a preferred form, the sheet is a composite of a thermoplastic sandwiched between two sheets of ballistic nylon. A preferred range of thickness of the sheet is 0.5 m.m. to 1 m.m. The preferred range of sheet weight is 150 to 300 grammes per square meter.

Ballistic nylon is relatively inexpensive and is hence preferred. However, twin ply KEVLAR by Dupont, whilst more expensive, offers greater resistance to cutting by knife and may be used to provide protection against a knife by-passing the plates, as well as a plate mounting function.

The plates may be formed of metals, ceramics or composite materials being resistant to knives and/or bullets or combinations of such materials such as ceramic and glass reinforced plastics material. In a first embodiment of the invention, the plates are planar. In a second embodiment as described hereinafter, non-planar plates are used, which are preferably dished plates. Preferably, the plates are formed from titanium alloy because of titanium's knife and bullet resistant qualities. An example of a suitable form of titanium is commercial purity grade 2 (CP2) titanium. However, most preferred, for reasons of costs, is aviation grade aluminium. The plates preferably have a diameter in the range 20 to 50 m.m. Most preferred is a diameter in the range 32 to 45 m.m. A disc shape is used for the plate, since it can assume any orientation about a central portion without varying the protection given.

Conveniently, the plates may have a nominally identical-size enabling the plates to be easily mass produced. However, in some embodiments it may be advantageous to use different size plates.

Preferably, for ease of manufacture, each plate is attached to the sheet by at least one rivet. Alternatively, the plates may be stitched to the sheet.

DESCRIPTION OF THE DRAWINGS

Specific embodiments of the invention will now be described, by way of example only, with reference to the drawings in which.

MODE OF CARRYING OUT THE INVENTION

Figure 1:
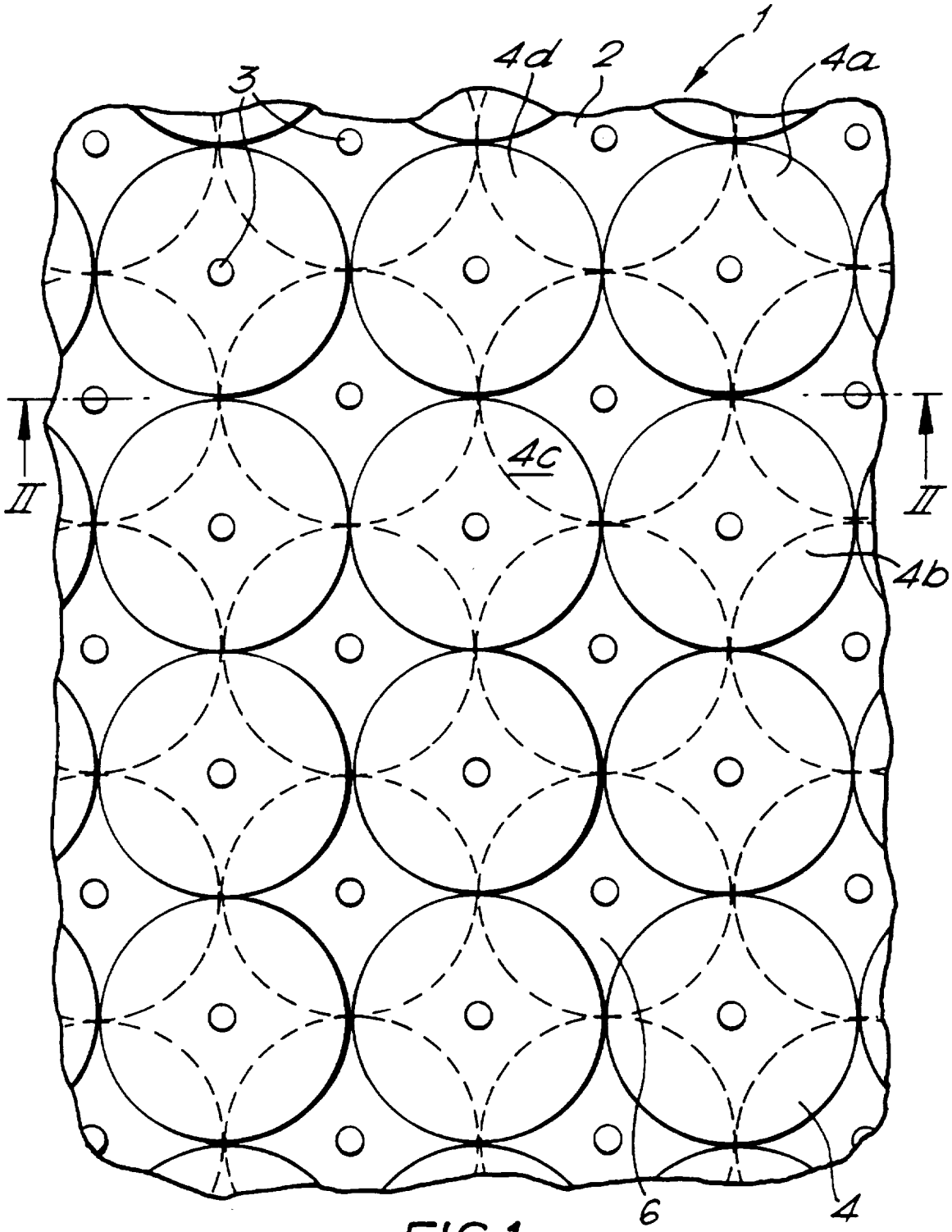
FIG. 1 shows a plan view of part of body armor in accordance with the invention.
Figure 2:
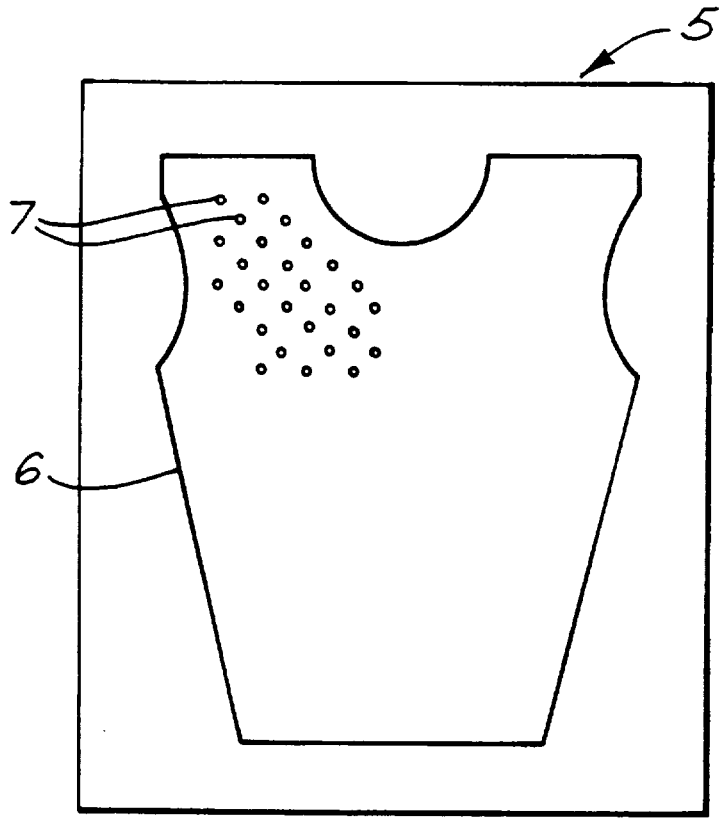
FIG. 2 shows a tool used to make the body armor shown in FIG. 1.

With reference to FIG. 1, body armor 1 comprises a flexible sheet 2 to which is fixed, by rivets 3, a plurality of plates 4 made of an aircraft grade aluminium such as aluminium alloy L156. The sheet 2 has a thickness of about 1 m.m. and is formed by placing either side of a thermosetting plastic sheet layer on at least one layer of ballistic nylon. The layers are heated and pressed together to impregnate the nylon layers with the thermosetting plastics material. The layers are allowed to cool and the thermosetting plastics material hardens to prevent the nylon layers parting. The impregnated hardened plastic material makes the sheet 2 resistant to pulling through of the rivets. The sheet 2 is cut to the desired shape and punched with a plurality of evenly spaced holes by pressing into the sheet 2 a cutting tool 5 comprising a periphery defining blade 6 and a plurality of hole punches 7 evenly distributed within the area defined by the blade 6, as shown by FIG. 2, into the sheet 2. To prevent fraying of the sheet 2, the tool 5 is heated to melt the thermosetting plastics material as it cuts.

The plates 4 are planar and have a diameter of 45 m.m. They are formed by stamping a sheet of the alloy having a thickness 0.5 m.m. The stamping operation also forms a central hole in each plate 4.

A group of four plates, for example, 4*a*, 4*b*, 4*c* and 4*d*, are then positioned adjacent the sheet 2 and their central holes aligned with the holes in the sheet 2. The rivets 3 are then passed through the holes and the rivet heads 3*a* and 3*b* formed, in a manner well known, to retain the plates 4 to the sheet 2. This process is repeated until one side of the sheet 2 called the threat side because it is the outer side directed towards knife or bullet attack, is covered with plates 4. In a similar manner, further plates 4 (shown in broken outline in FIG. 1) are riveted to the body or protected side of the sheet 2 which is the side adjacent to the body of a wearer of the armor 1. The arrangement of these inner plates 4 is such that they each register with an exposed area 6 of sheet 2 between each group of plates 4 on the outer threat side. Thus for a knife to penetrate the armor 1 it has to be thrust through at least one of the plates 4 as well as the sheet 2.

Figure 3:
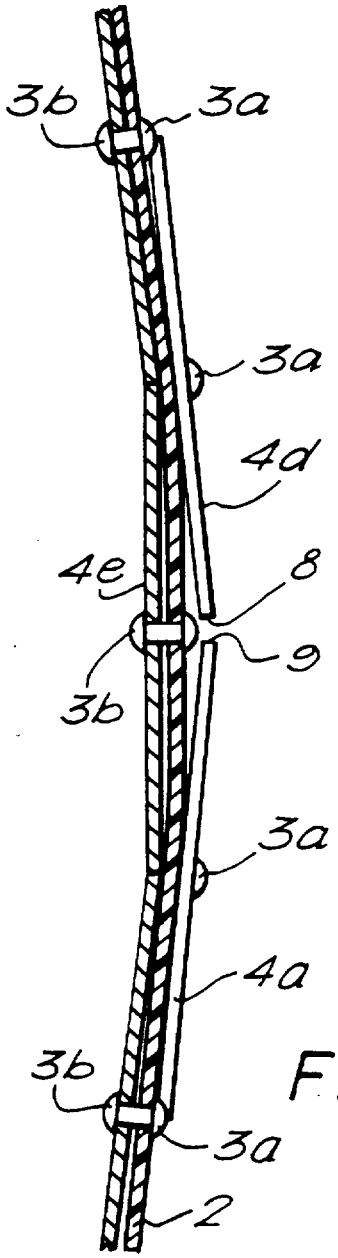
FIG. 3 shows a section through the body armor shown in FIG. 1 along line III—III with the body armor being flexed.
Figure 4A:
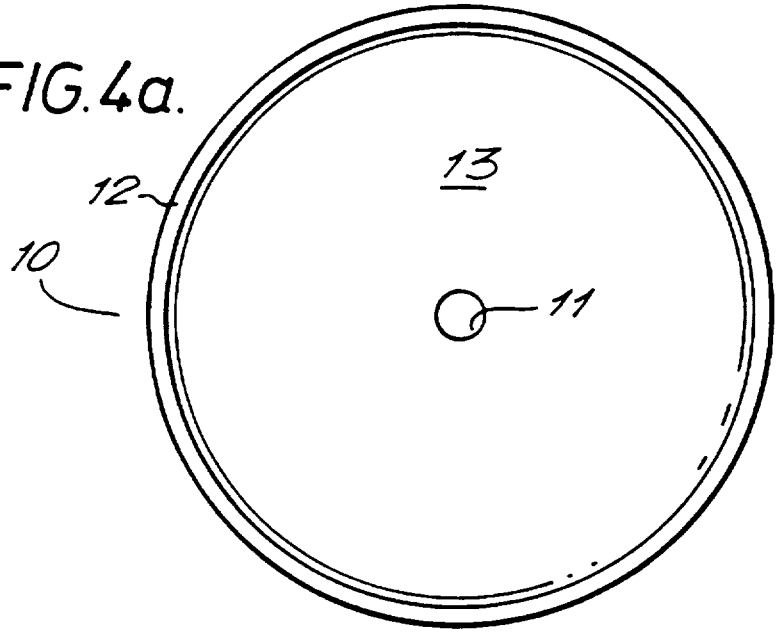
FIGS. 4*a*–4*d* show armour plates from a second embodiment of the invention.
Figure 4B:
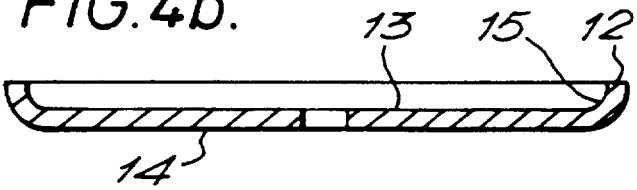
Figure 4C:
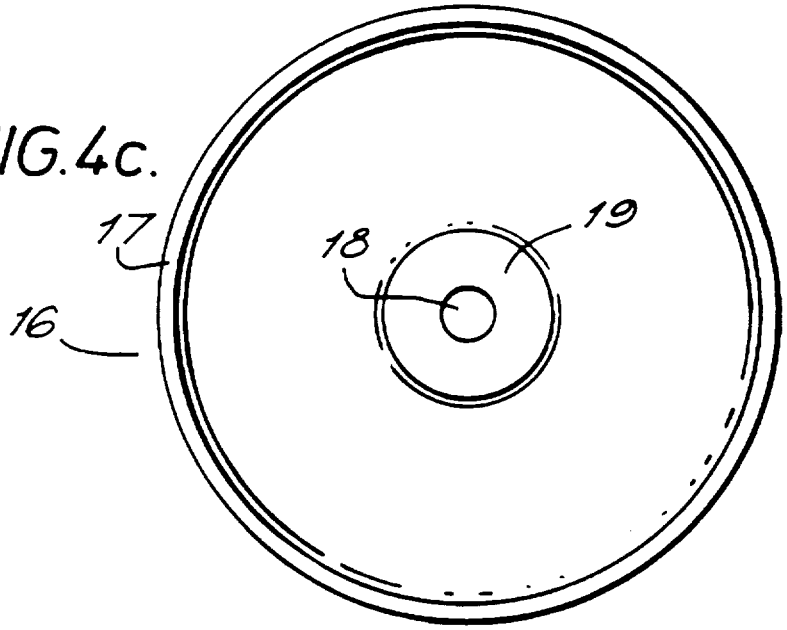
Figure 4D:
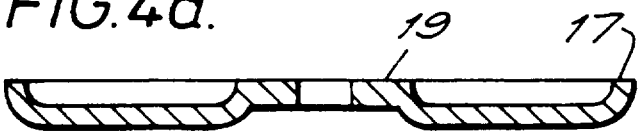

FIG. 3 shows the armor 1 in a flexed state and it can be seen that because the (inner) plate 4*e* is attached to the body side of the sheet 2 it does not prevent edges 8 and 9 of the plates 4 on the outer threat side from rising relative to the sheet 2, as it would if plate 4*e* were on the outer side of the sheet 2. This is a significant feature in increasing the flexibility of the armor 1 over prior-art designs. Further, because the inner plate 4*e* does not make contact with the outer plates 4*a*, 4*b*, 4*c* and 4*d*, the friction caused by relative movement of the plates 4 is greatly reduced with respect to past designs conferring even greater flexibility. In an unflexed state the edges of the plates 4 abut to present a minimal gap therebetween.

In an alternative embodiment, the plates have a dish shape as shown in FIG. 4. The plates comprise an inner, threat side disc shown in FIGS. 4*a*, 4*b*, and an outer body side disc shown in FIGS. 4*c*, 4*d*.

The threat side disc 10 is formed from alloy L156 aircraft grade aluminium, having a thickness of 1.6 m.m., in a stamping operation. The diameter of the disc 10 is 45 m.m. and it is provided with a 4 m.m. diameter centrally located hole 11 which passes through the major plane of the disc. The edge of the disc 10 is upturned out of the major plane of the disc to form a peripheral rim 12 bounding a generally planar front face 13 and rear face 14. The rim 12 is formed as the disc is stamped out of the sheet material to have an inner face radius 15 of 1.6 m.m.

The body side disc 16 is generally similar to the threat side disc 10, having a diameter of 45 m.m. and a peripheral rim 17. However, the central hole 18 is bounded by a boss 19 which projects out of the major plane of the disc to provide an annular planar surface co-planar with the rim 17. The boss has a diameter of 26 m.m.

The discs are mounted on a flexible sheet in substantially the same manner as in the earlier described embodiment. Thus a plan view would have a substantially similar form as that shown in FIG. 1.

Figure 5A:
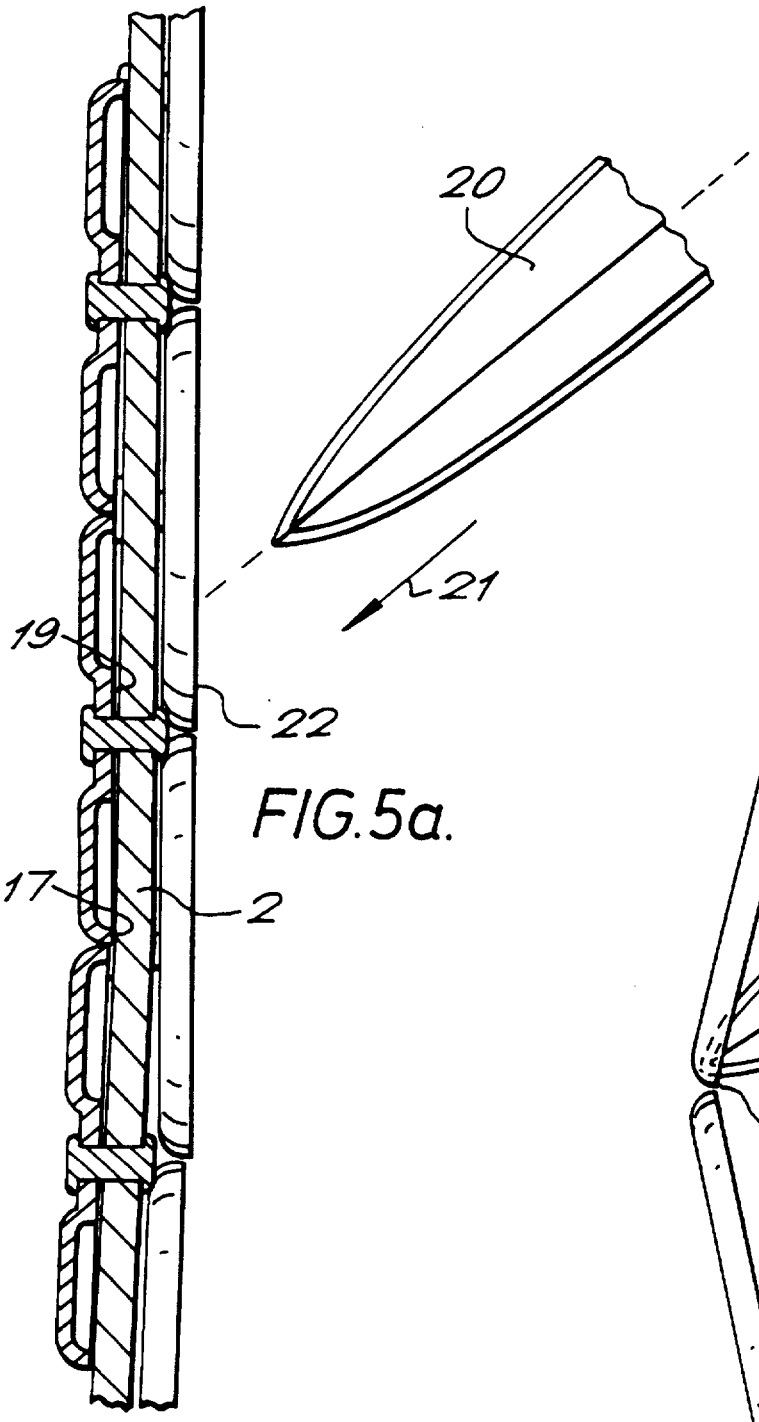
FIGS. 5*a* and 5*b* show the second embodiment of the invention under knife attack.
Figure 5B:
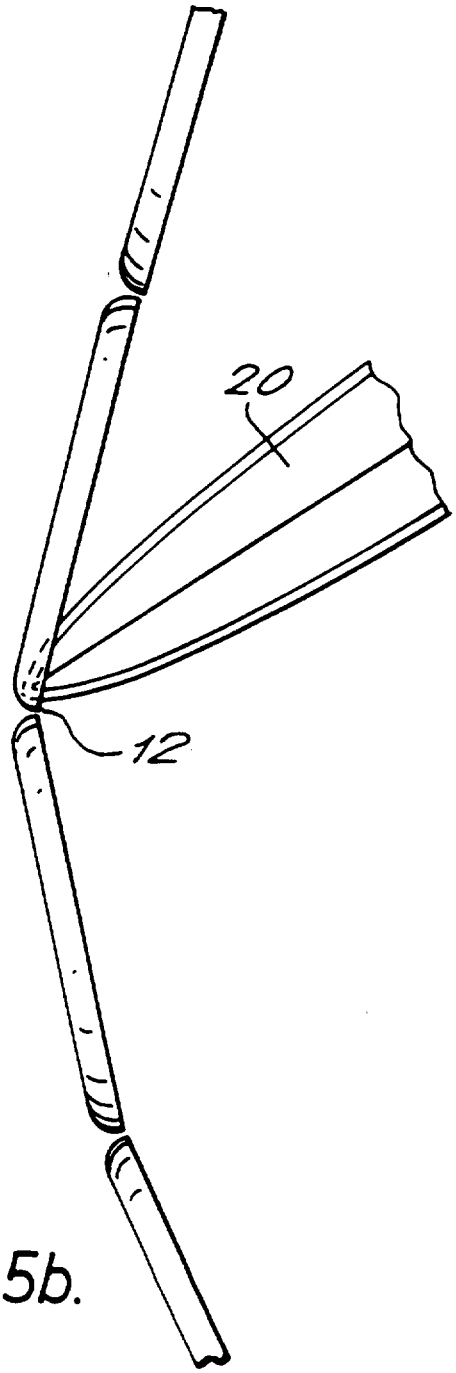

The purpose of the rims will be described with reference to FIG. 5. FIG. 5*a* shows a section through the plates and sheet with the armor being subjected to a thrust from a knife 20 along the broken line in the direction of arrow 21. The knife 20 makes contact with the outer threat side disc 22 and the force of the thrust distorts the armor as shown in FIG. 5*b* (the body side discs and sheet are omitted for clarity). The disc 22 deflects the blade of the knife 20 downwards towards its edge where it is captured by the outwardly directed rim 12 thus preventing the blade from passing through any of the sheets exposed between the discs by their movement.

The rims 17 of the inner body side discs also act to capture the blade in a similar manner. Discs provided with rims thus present an enhanced level of protection over the planar discs described in the earlier embodiment.

As shown in FIG. 5*a*, the boss 19 prevents the rim 17 from being pressed into the membrane 2 by spreading the load. This prevents puckering of the sheet and a reduction in flexibility.

Figure 6:
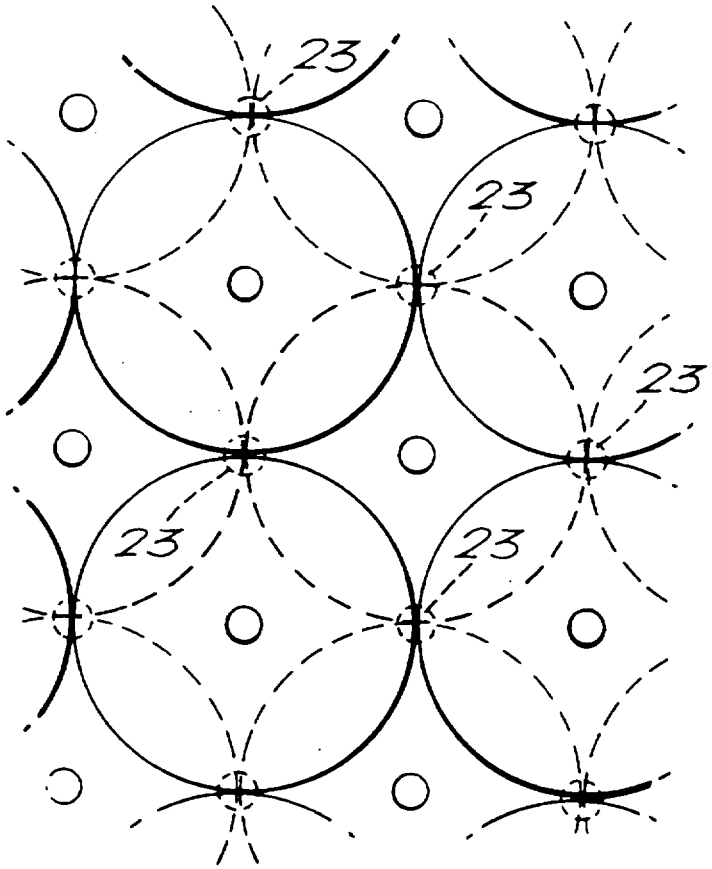
FIGS. 6 and 7 show further embodiments of the invention.

The protection of the earlier described embodiments can be further enhanced by a flat-headed rivet 23 being passed through the sheet at the junctures of both sets of plates the head lying beneath the threat side plates as shown in FIG. 6. The head of the rivet thus acts as a small plate. A flat head rivet is preferred since it does not significantly add to the armor thickness and does not impede plate flexibility.

To prevent the plates adjacent the body from being pushed out of the way by a knife thrust, a layer of polycarbonate sheet may be placed between the plates and the wearer's body as a support sheet. The polycarbonate sheet may be of a thickness in the range 0.75 to 1 m.m. has been found suitable.

A layer of closely woven ballistic material, such as KEVLAR an aramid made by Du Pont in 4 to 32 plys quilted together, may alternatively be used as a support sheet. Such an arrangement would enhance protection against ballistic threat. Alternative materials include TWARON by Axo, SPECTRA CLOTH and SPECTRA SHIELD by Allied Signal and DYNEMA by Dutch State Mine in cloth and non-woven laminated form.

The most preferred form of support sheet is a combination of polycarbonate and woven ballistic material since the ballistic material provides protection against bullets and the polycarbonate has useful shock-absorbing properties.

The support sheet may be provided as a separate under garment, an integral layer of the armor or a detachable lining which may be attached by zips or felt and hook fastners to upgrade the protection.

It has been found that where the armor curves about the side of the torso the support sheet may be dispensed with because the plates adjacent the body are more resistant to being pushed out of the way. The support sheet may therefore be confined to the relatively flat areas of the chest, back and stomach saving weight and conserving expensive materials.

In further alternative embodiments of the invention, the plates may be attached to the sheet by stitching, for example, by forming two or more centrally disposed holes in each plate and sewing to the sheet, in the manner of attaching buttons to a garment. It may be possible to use conventional buttoning machines to do this with little or no modification. Alternatively, the central hole may be dispensed with and an attachment loop formed at the face of the plate to accept thread. The advantage of sewing would be that the hole making operation, in which the sheet is perforated, may be dispensed with. It may also be possible to produce a plate with a projection which can be pushed through the sheet and opened or bent over to abut the other side of the sheet and so retain the plate. However, it may be difficult in such operations to ensure the correct distribution of the plates.

The body armor may be used alone or in combination with other armours to provide greater protection. To defeat present armor piercing bullet threats, conventional body armor includes blocks or inserts of ceramic material held in pockets over the heart or other critical organs. Because of their bulk, weight and inflexibility the wearer's movement is greatly impeded. Further, because of these drawbacks the number of inserts are limited to give protection to a few critical organs most likely to be hit by a bullet. Other critical areas which are not protected include the underarm region. This region in particular requires a great flexibility of movement which cannot be achieved by conventional armor.

The body armor in accordance with the invention, may be placed in front of conventional ballistic nylon or other ballistic protective material, for example KEVLAR, to both give protection against knives and enhanced bullet protection. It has been found that the plates will advantageously deform bullets reducing their penetrating abilities and/or cause the bullet to tumble, that is, the bullet rotates such that the nose is no longer facing the direction of travel. This will significantly increase protection against a hit by one bullet and hits by subsequent bullets giving a greater multi-shot capability. The plates may also spread the impact energy of the bullet over a greater area reducing the shock of impact. The thickness of the conventional armor may be advantageously reduced conferring the benefits of reduced cost and enhanced protection against knife and bullet attack. The underarm region, in particular, may be protected by the plates.

In test-firings of a steel cored armor piercing side-arm ammunition a 25 ply KEVLAR bullet resistant vest was penetrated by the bullets. However by placing body armor in accordance with the invention in front of the vest none of the firings penetrated. It is envisaged that a heavier gauge of disc will protect against penetration by armor piercing rifle ammunition.

Figure 7:
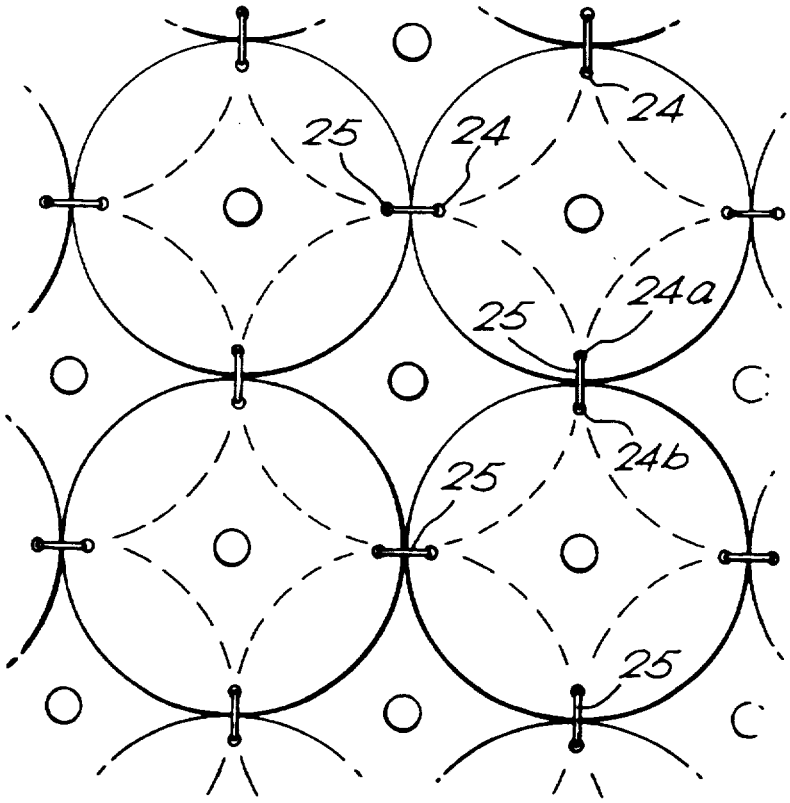

FIG. 7 shows a yet further embodiment of the invention in which each plate is provided with four holes 24. Adjacent holes of adjacent plates, for example, 24*a* and 24*b* have passed through them a stainless steel tie 25 which is formed into a loop and secured by twisting the ends. This prevents separation of the plate edges when under attack. The tie may be made from nylon or other suitable materials.

We claim:

1. Armor, comprising:

a flexible sheet having a threat side facing a direction of threat and a protected side facing away from the direction of threat;

a first group of disc-shaped armor plates attached at their respective centers to the protected side of said sheet;

a second group of disc-shaped armor plates attached at their respective centers, to the threat side of the sheet and defining exposed regions of sheet between the plates of the second group;

the plates of the first and second groups arranged such that the plates of the first group on the protected side are in overlapping registration with the plates of the second group attached to the threat side, and such that the centers of the plates of the first group register with the exposed regions between the plates of the second group so that the plates of the first group also register with the exposed regions thereby preventing penetration of the armor through the exposed regions.

2. Armor as claimed in claim 1 wherein the plates of the first group do not overlap one another, and the plates of the second group do not overlap one another.

3. Armor as claimed in claim 1 wherein the plates of said first and second groups are planar.

4. Armor as claimed in claim 1 wherein at least the plates of the second group include outer rims projecting out of the major plane of the plates toward the direction of threat.

5. Armor as claimed in claim 1 wherein the plates of said first and second groups have a diameter in the range of 20 to 50 m.m.

6. Armor as claimed in claim 5 wherein the plates of said first and second groups have a diameter in the range of 32 to 45 m.m.

7. Armor as claimed in claim 1 wherein the plates of said first and second groups are attached by rivets passed through centrally located holes.

8. Armor as claimed in claim 1 wherein the plates of said first and second groups are formed from at least one of aluminum, titanium, and ceramic.

9. Armor as claimed in claim 1 wherein the sheet is a composite of a thermoplastic sandwiched between sheets of ballistic material.

10. Armor as claimed in claim 9 wherein the composite sheet has a thickness in the range of 0.5 to 1 m.m.

11. Armor as claimed in claim 10 wherein the sheet has a weight in the range of 150 to 300 grams per square meter.

12. Armor as claimed in claim 11 wherein a third group of plates each of substantially smaller size than those of the first group of plates is arranged on the sheet such that each plate of the third group of plates lies beneath immediately adjacent edges of adjacent plates of the first group.

13. Armor as claimed in claim 12 wherein the third group of plates comprises flat-headed rivets.

14. Armor as claimed in claim 1 including flexible support means arranged adjacent the first group of plates to prevent significant movement of the first group of plates out of the plane of the sheet.

15. Armor as claimed in claim 14 wherein the flexible support means comprises a support sheet of polycarbonate.

16. Armor as claimed in claim 14 wherein the flexible support means comprises ballistic nylon.

17. Armor as claimed in claim 14 wherein the support means comprises polycarbonate and ballistic nylon in combination.

18. Armor as claimed in claim 1 wherein ties are provided connected between adjacent plates to prevent separation of their edges.

19. Armor as claimed in claim 1, in which said plates of said first and second groups are regularly arranged in rows and columns.

20. Armor as claimed in claim 1, in which said plates of the first and second groups are of uniform size.

21. Armor, comprising:

a flexible sheet having a threat side facing a direction of threat and a protected side facing away from a direction of threat;

a first group of disc-shaped armor plates attached to the protected side of said sheet;

a second group of disc-shaped armor plates attached to the threat side of said sheet and defining exposed regions of sheet between the plates of the second group;

said plates of said first and second groups arranged such that the plates of said first group on the protected side are in overlapping registration with the plates of said second group attached to the threat side and with the exposed regions between the plates of the second group thereby preventing penetration of the armor through the exposed regions, in which said plates on both sides of said flexible sheet include outer rims projecting out of a major plane of said plates towards the direction of threat.

22. Armor as claimed in claim 21 wherein the plates of said first and second groups are each locally attached at a substantially central region to the flexible sheet.

23. Armor as claimed in claim 21 wherein the plates of the first group are provided with load spreading means to prevent the rim being pressed into the sheet.

24. Armor as claimed in claim 23 wherein the load spreading means comprises a centrally located boss.

* * * * *